United States Patent [19]

Thompson et al.

[11] 4,134,724

[45] Jan. 16, 1979

[54] PROCESS FOR DYEING HIGHLY MOISTURE ABSORBENT CELLULOSE CONTAINING TEXTILE MATERIALS

[75] Inventors: Dewey T. Thompson; John H. Parkins; James B. Nichols, all of LaGrange, Ga.

[73] Assignee: Milliken Research Corporation, Spartanburg, S.C.

[21] Appl. No.: 850,458

[22] Filed: Nov. 10, 1977

[51] Int. Cl.[2] ..... D06P 3/60

[52] U.S. Cl. ..... 8/54.2; 8/1 D; 8/1 G; 8/21 A; 8/34

[58] Field of Search ..... 8/54.2, 1 D, 1 G, 21 A, 8/34

[56] References Cited

U.S. PATENT DOCUMENTS 2,947,016 8/1960 Thompson ..... 15/209

OTHER PUBLICATIONS

Moncrieff, R. W., "Man-Made Fibres" (Wiley) 1975, pp. 912–923.

*Primary Examiner*—A. Lionel Clingman

*Attorney, Agent, or Firm*—Glen M. Burdick; H. William Petry

[57] ABSTRACT

An improved process of dyeing highly moisture absorbent cellulose containing textile materials having a ratio of filling to warp of between 77 to 23 and 50 to 50 in which such textile materials are woven from yarn having a range of twist multiplier of from about 2.25 to about 5.00 is provided in which water is applied to a first surface of the textile material to effectively moisten such surface. a liquid dye admixture is applied to a second surface, the second surface being opposite the first surface, in an amount sufficient to cover the second surface. The resulting textile material is then maintained in a holding zone for a period of time effective to allow the dyestuff constituent present in the liquid dye admixture to migrate through the textile material. Once the desired dyestuff migration has occurred, the dyed textile material is heated to a temperature of from about 300° F to about 400° F to fix the dyestuff and dry the dyed textile material. When desired, the dyed highly moisture absorbent cellulose containing textile materials can be cut into towels of predetermined sizes and overedged to prevent fraying of the edges of the resulting towels.

11 Claims, 1 Drawing Figure

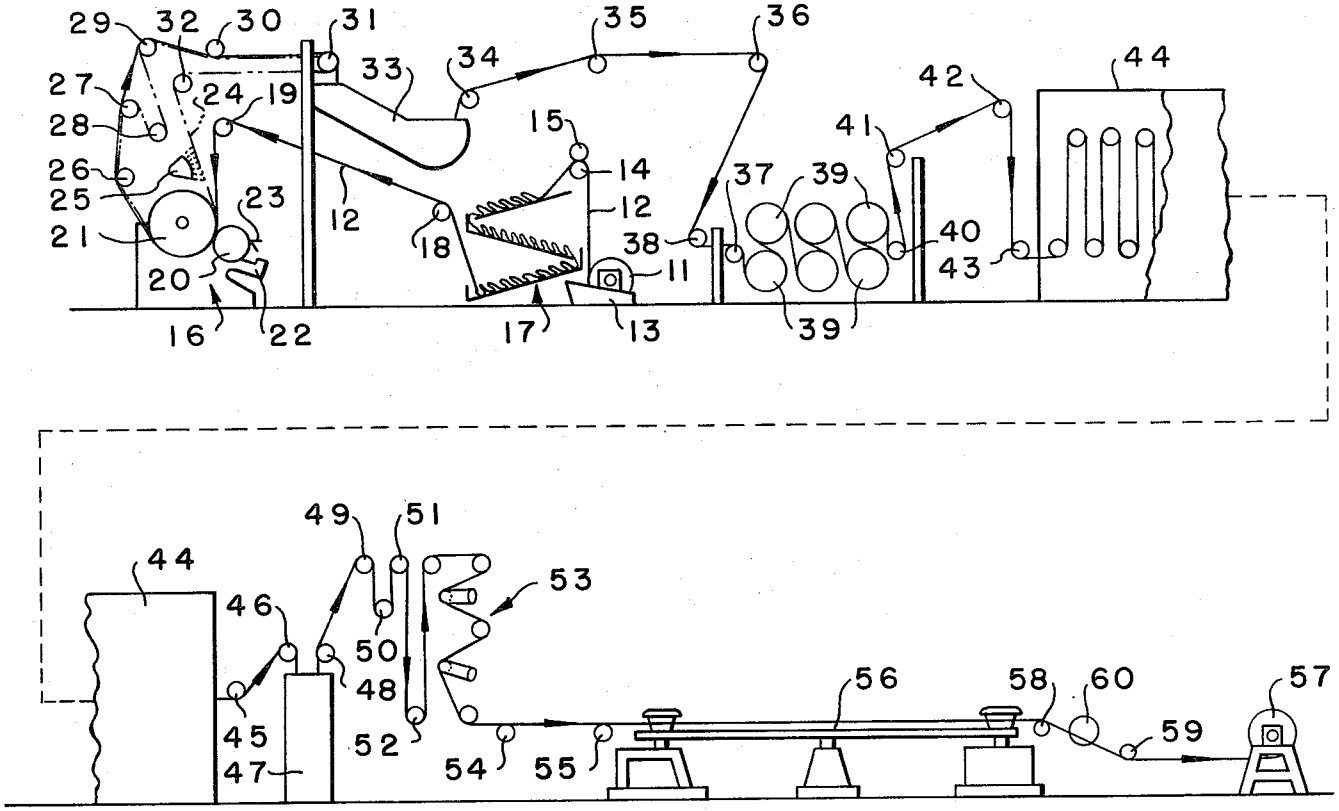
44
42
41
40
43
39
39
36
37
38
11
13
35
14
12
15
17
34
18
33
12
31
19
22
30
24
23
16
32
20
29
27
28
26
25
21
57
59
60
58
56
55
53
54
51
50
48
52
49
46
45
47
44

PROCESS FOR DYEING HIGHLY MOISTURE ABSORBENT CELLULOSE CONTAINING TEXTILE MATERIALS

Industrial wiping towels fabricated from highly moisture absorbent cellulose containing textile materials have heretofore been known and used in service stations, printing establishments, machine shops and the like to remove oil, grease, water, paint, and other soils or stains from surrounding surfaces. Such industrial wiping towels are generally manufactured with a one-up, one-down orsnaburg weave wherein about two-thirds of the fabric weight is composed of softly twisted filling yarn and the remaining one-third of the weight of the fabric is composed of a fine and more highly twisted warp yarn. Generally, though not necessary, the warp yarns are composed of the same fiber mix as the filling yarns which allows the warp yarns to be absorbent though not usually as much as the filling yarns. After the fabric has been cut into predetermined sizes, the resulting towel is over-edged around the cut sides to prevent subsequent fraying in laundering and/or use. The fabric construction of such industrial wiping towels is generally set forth in U.S. Pat. No. 2,947,016. The above-described article is generally sold to industrial laundries. At the laundry, the towels are washed to render the natural absorbency to the towel, dyed with direct colors, dried and then packaged for rental to the user.

The practice of dyeing shop towels in laundering equipment is an old art and is usually achieved by adding direct dyestuff, in powder form, to the wet load followed by addition of salt to exhaust sufficient dye onto the towels to give the desired shade depth. The use of direct colors has been dictated heretofore because of simplicity and economics.

Public awareness of environmental pollution, both atmospheric and water, has brought heavy pressure on all phases of industry to reduce and/or eliminate those agents that pollute the atmosphere and streams. The industrial laundry has not escaped these pressures. It is this scenario that has produced a demand for predyed towels by the laundry trade that will allow them to stop introducing dyestuffs to the laundry effluent. To fill this need, it is necessary that the towel be dyed with colors, by the towel manufacturer, that are fast to the rigors of industrial launderings over the useful life of the towel, while at the same time do not create similar environmental pollution problems for the towel manufacturer.

The art of dyeing textile materials is also will known. For example, textile materials have heretofore been dyed with direct dyes, vat dyes, sulfur dyes, acid dyes, basic dyes, dispersed dyes and the like, the particular choice being dictated primarily by the type of fibers composing the textile material, the end-use desired of the dyed textile material, and economics. Similarly, numerous dyeing equipment and processing techniques have heretofore been set forth.

However, the use of conventional dyeing techniques and equipment have not been practical for the dyeing of highly moisture absorbent cellulose containing textile materials for use as shop towels, either because such dyeing techniques of the prior art are uneconomical or such dyeing techniques create environmental pollution problems for the manufacturer or processor. Therefore, a need has existed for an improved process for dyeing highly moisture absorbent cellulose containing textile materials which is economical, substantially eliminates environmental pollution problems and which further overcomes additional disadvantages of prior art dyeing techniques.

Therefore, an object of the present invention is to provide an improved process for the dyeing of highly moisture absorbent cellulose containing textile materials which is economical and does not create environmental pollution problems. This and other objects of the invention will be apparent to those skilled in the art upon a reading of the following detailed disclosure.

According to the present invention, we have discovered an improved process for dyeing highly moisture absorbent cellulose containing materials which is economical and does not create environmental pollution problems for the manufacturer or the subsequent processor of the finished product. Broadly described, the invention resides in an improved process for dyeing highly moisture absorbent cellulose containing textile materials having a ratio of filling to warp of between 77 to 23 and 50 to 50 in which such textile materials are woven from yarn having a range of twist multiplier of from about 2.25 to about 5.00 which comprises the steps of (a) applying an effective amount of water to a first surface of the textile material to moisten such surface; (b) applying an effective amount of a liquid dye admixture to a second surface of the textile material to sufficiently cover the second surface, the first and second surfaces of the textile material being opposite each other; (c) maintaining the resulting textile material in a holding zone for a period of time effective to allow the dyestuff constituent in the liquid dye admixture to migrate throughout the textile material; and thereafter, (d) heating the dyed textile material to a temperature of from about 300° F to about 400° F for a period of time effective to dry the dyed textile material and to fix the dyestuff. Thereafter, if desired, the dry dyed textile material can be framed to width, cut into towels of predetermined sizes and the edges of such towels over-edged to prevent same from fraying. More specifically, the most desired liquid dye admixture applied to the textile material is an aqueous dye admixture containing from about 0.25 to about 5 weight percent of a fiber reactive dyestuff constituent, from about 0 to about 20 weight percent of a dye fixation agent, from about 1 to about 6 weight percent of a buffer, from about 0.1 to about 2.5 weight percent of a penetrant, and from about 0.1 to about 2.5 weight percent of a defoaming agent.

A drawing accompanies and is made a part of this disclosure. The drawing is a schematic representation of apparatus which may be employed to practice the process of the present invention for dyeing highly moisture absorbent cellulose containing textile materials.

As previously stated, the present invention is directed to an improved method for dyeing highly moisture absorbent cellulose containing textile materials. Such textile materials are especially useful in the fabrication of industrial towels and are generally characterized as having a ratio of filling to warp of between 77 to 23 and 50 to 50. Especially desirable results can be obtained when about 67 percent of the weight of the fabric is filling yarn and the remaining 33 percent is warp yarn. Moreover, the yarns employed in weaving such a textile material should generally be characterized by a range of twist multiplier of from about 2.25 to about 5.00. It is generally desired to employ a range of twist multiplier for the filling of from about 2.25 to about 4.50 and for the warp, a range of from about 3.50 to about 5.00.

The filling yarns and warp yarns employed to weave the highly moisture absorbent cellulose containing textile materials processed by the present invention can be formed of cotton fibers or a blend of cotton and acrylic fibers. Further, the filling yarns do not have to be the same as the warp yarns. However, in most applications, the filling yarns and warp yarns will generally form of the same fiber mix. When employing either filling yarns and/or warp yarns formed of a blend of cotton and acrylic fibers, the amount of the cotton fibers and acrylic fibers in the blend can vary widely. Generally, however, textile materials woven of yarns formed of a fiber mix containing from about 68 to about 50 weight percent cotton fibers and from about 32 to about 50 weight percent acrylic fibers are especially useful in the practice of the present invention.

To more fully describe the improved process for dyeing the previously described high moisture absorbent cellulose containing textile materials of the present invention, reference will now be made to the drawing.

A supply roll 11 of moisture absorbent textile material 12 is mounted in a suitable container 13. The advancement of material 12 through the apparatus is indicated by the solid line in the direction of the arrows. Material 12 is withdrawn from supply roll 11 by passing the material through driven nip rolls 14 and 15. Nip rolls 14 and 15, in addition to assisting in the advancement of material 12, further function to align the material with dye applicator means 16. Material 12 advances from driven nip rolls 14 and 15 into a first accumulator 17 depicted as three inclined planes. After sufficient material has been accumulated in first accumulator 17, the textile material 12 is guided over a plurality of support rollers (two being shown) 18 and 19 and brought into contact with dye applicator means 16. It should be noted that the material is advanced into the first accumulator at substantially the same rate it is removed therefrom after the first initial accumulation of the material has occurred.

Dye applicator means 16 is depicted as a conventional printing apparatus having printing roller 20, pressure roller 21, trough 22 and doctor knife 23. Printing roller 20 is positioned within trough 22 so that the liquid dye admixture to be applied to one surface of textile material 12 can be picked up by roller 20 and subsequently applied to the textile material. Doctor knife 23 is adjustably positioned in a spaced relationship with printing roller 20 to remove excess dye admixture from the roller prior to the printing operation. The excess dye admixture removed from printing roller 20 by doctor knife 23 is returned to trough 22 by gravity.

Gray backing fabric 24, an endless backing fabric represented by the dashed line, is positioned between pressure roller 21 and textile material 12. In carrying out the process of the present invention, we have found that gray backing fabric 24 must be water wet if an even migration of dye throughout textile material 12 is to occur. Thus, sprinkler means 25 is intermittently operated to deliver water to gray backing fabric 24 to insure that same is maintained wet with water so as to moisten the surface of textile material 12 opposite the surface of such material where the liquid dye admixture is applied. Endless gray backing fabric 24 is maintained under tension by the use of a plurality of support rollers and idler rollers, such as those depicted rollers 26, 27, 28, 29, 30, 31, and 32.

After the desired dye admixture has been applied to one surface of textile material 12, the dyed textile material is passed over a series of rollers 26, 27, 29, 30, and 31 and into a second accumulator 33, such being depicted as a J-box. It should be noted that the wet gray back fabric is maintained in contact with the textile material during passage of the textile material over a portion of the before-mentioned rollers to further assure that the surface of the textile material opposite the surface where the dye admixture was applied is maintained in a moist state. The dyed textile material is maintained in a second accumulator 33 for a period of time effective to allow migration of the dyestuff in the liquid dye admixture throughout the textile material. In a continuous operation, the advancement of the textile material into the second accumulator is substantially equal to the rate of withdrawal of the material therefrom.

The textile material removed from second accumulator 33 is advanced over a plurality of rollers, five being depicted as support rollers 34, 35, 36, 37, and idler roller 38 and then over a plurality of heated cans, 39, which partially dry the wetted, dyed textile material. After passage over heated cans 39, the partially dried, dyed textile material is again passed over a plurality of rollers, four being depicted, e.g., support rollers 40, 41, 42, and idler roller 43 and into thermal fixation oven 44. The rate of movement of the textile material through thermal oven 44 is determined so as to maintain the textile material within the oven for a period of time to insure substantial drying of the textile material and the fixation of the dyestuff thereto. Generally desirable results can be obtained when oven 44 is maintained at a temperature of from about 300° F to about 400° F and the textile material is maintained in the oven for a period of time of from about 1 to about 5 minutes. Preferably the oven is maintained at a temperature of from about 325° F to about 375° F and the material is maintained therein for a period of time of from about 1 to about 2 minutes.

The substantially dried, dyed textile material is then advanced from oven 44 over a plurality of rollers, such as idler roller 45 and support roller 46, into a steamer 47 to restore the natural moisture content to the textile material. The resulting dyed textile material is maintained in steamer 47, which is operated at a temperature above 212° F, for a period of time ranging from about 2 to about 10 seconds. The steamed, dyed textile material is thereafter advanced from steamer 47 over a plurality of rollers, such as support rollers 48, 49, idler roller 50, support roller 51 and idler roller 52 to a fabric straightening means 53 wherein the weave of the steamed, dyed textile material is straightened. Thereafter, the straightened textile material is advanced over a plurality of rollers, such being depicted by support rollers 54 and 55, to tenter frame 56 where the textile material is framed to its finished width. The straightened, framed, dyed textile material can then be advanced to take-up roll 57. However, in manufacturing the highly moisture absorbent dyed cellulose containing textile materials in accordance with the subject invention, it is generally desirable, prior to advancing the textile material to take-up roll 57 to first advance the textile material through a series of rollers, such as support roller 58 and idler roller 59 having positioned therebetween cutting means, such as rotary knife cutter 60 for slitting the material to the desired width. As is evident, the number of rotary knife cutters employed will be dependent upon the width of the fabric and the desired size of the finished product.

Once the dyed textile material has been placed upon the take-up roll, such can be moved for storage or further processing. When the dyed highly moisture absorbent cellulose containing material is to be used for the production of industrial towels, the dyed textile material is removed from take-up roll 57, cut into towels of predetermined sizes by any suitable means, such as a shear, a rotary knife, or by handcutting and thereafter the edges of the towels can be over-edged with any suitable over-edging machine, such being known in the art, to prevent fraying of the edges.

The dyestuff applied to one surface of the moisture absorbent cellulose containing textile material in accordance with the present invention can be a soluble vat dyestuff, or a fiber reactive dyestuff. Further, such dyestuff can be applied to one surface of the textile material by any suitable means, such as printing, spraying and the like. The amount of dyestuff present in the liquid admixture can vary widely, such being determined to a large extent upon the particular shade or color desired in the finished product. Generally, however, especially desirable results can be obtained when the liquid dye admixture is an aqueous dye admixture containing from about 0.25 to about 5 weight percent of a fiber reactive dyestuff, preferably from about 0.5 to about 2 weight percent of the dyestuff constituent. In addition the liquid dye admixture can contain other constituents such as dye fixation agents, buffers, penetrants, defoaming agents, and, if desired, thickeners. When applying the aqueous dye admixture to one surface of the textile material using a printing technique, it is preferred that the aqueous dye admixture contain, in addition to the before-mentioned amount of the fiber reactive dyestuff constituent, from about 0 to about 20 weight percent of a dye fixation agent, from about 1 to about 6 weight percent of a buffer, from about 0.1 to about 2.5 weight percent of a penetrant and from about 0.1 to about 2.5 weight percent of a defoaming agent. An especially preferred liquid dye admixture is an aqueous dye admixture containing from about 0.5 to about 2 weight percent of a fiber reactive dye, from about 3 to about 7 weight percent of a dye fixation agent, from about 1.5 to about 3 weight percent of a buffer, from about 0.2 to about 0.5 weight percent of a penetrant and from about 0.2 to about 1 weight percent of a defoaming agent.

When employing an aqueous dye admixture containing a soluble vat dyestuff, other constituents such as buffers, oxidizing agents, acid splitting agents, preservatives, catalysts, defoaming agents, penetrants and the like may be employed. The particular aqueous dye admixture will vary depending, to a large extent, upon the dyeing formulations used by the dyes. However, a typical formula is as follows:

| Constituent | % (by wt.) |
|---|---|
| Indigosal Blue IBC (soluble vat dyestuff) | 1.0 |
| Urea (buffer) | 3.485 |
| Aqueous Admixture Sodium Chlorate (1:3)* (oxidizing agent) | 3.0 |
| Aqueous Admixture Ammonium Sulfocyanide (1:1)* (acid splitting agent) | 3.0 |
| Thiourea | 1.82 |
| Aqueous Solution $NH_4OH$ (26%) (preservative) | 1.00 |
| Aqueous Admixture Ammonium Vanadate (1:100)* (catalyst) | 1.00 |
| 2-Ethyl Hexanol (defoaming agents) | 0.25 |
| Pine Oil (penetrant) | 0.14 |
| Penetrate | 0.49 |
| Water | 84.815 |

*parts of constituent:parts of water. Weight percent employed is weight of aqueous admixture As previously stated, the dyestuff constituents useful in the practice of the present invention are th soluble vat dyestuffs, and the fiber reactive dyestuffs.

The term "soluble vat dyes" is to be understood to mean those dyestuff constituents which are solubilized, such as by reduction with sodium hydrosulfite or esterification, and subsequently applied to the fiber. Thereafter, the applied dyestuff is oxidized by a suitable oxidizing agent back to its insoluble form. Typical of such soluble vat dyes are tabulated as follows:

| Class | Characteristic Structural Unit | Example |
|---|---|---|
| thiazine | 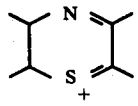 | 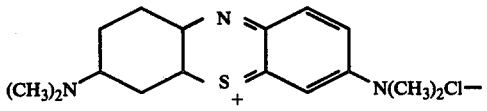 |
| sulfur | 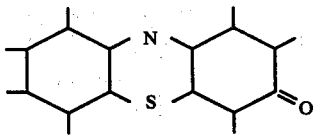 | |
| | 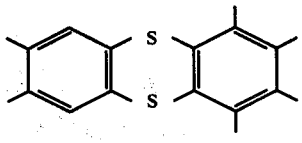 | |
| | 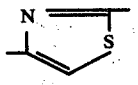 | |

-continued

| Class | Characteristic Structural Unit | Example |
|---|---|---|
| anthraquinone | 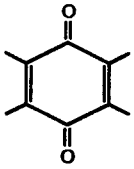 | 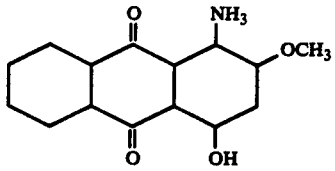 |
| | | 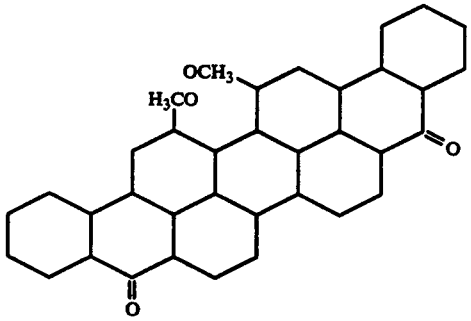 |
| indigoid | 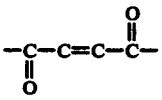 | 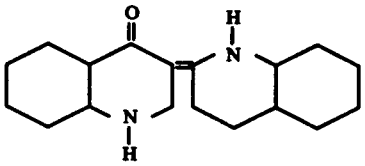 |
| phthalocyanine | tetrabenzopor-phyrazine nucleus | 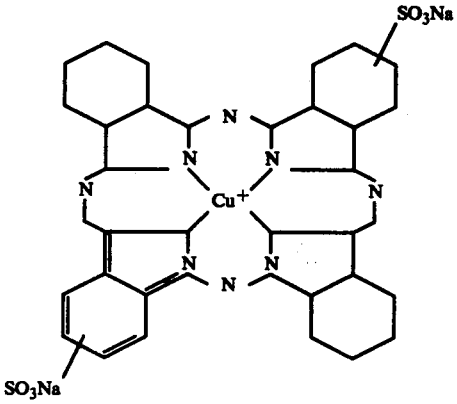 |

The term "fiber reactive dyes" is to be understood to mean those dyes which contain a functional group capable of forming a covalent chemical bond with a fiber. The chromophore of such dyestuffs are generally classified as azo, anthraquinone, phthalocyanine and stilbene dyes. Typical of such fiber reactive dyes are:

| Reactive group | Name | Example |
|---|---|---|
| 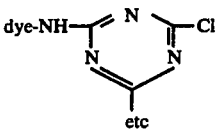 | dichloro-triazinyl | 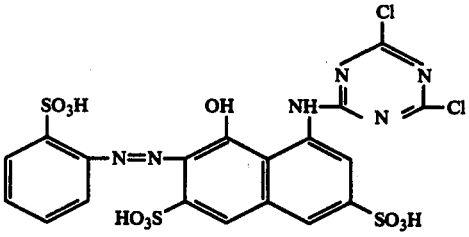 |

-continued
| Reactive group | Name | Example |
|---|---|---|
| 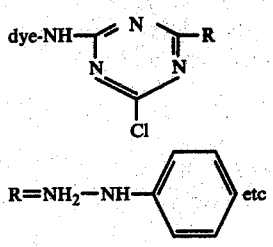 | monochloro-triazinyl | 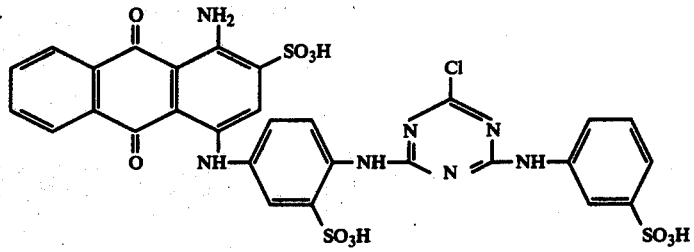 |
| 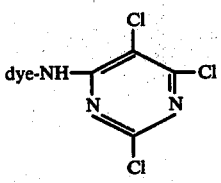 | trichloro-pyrimidyl | 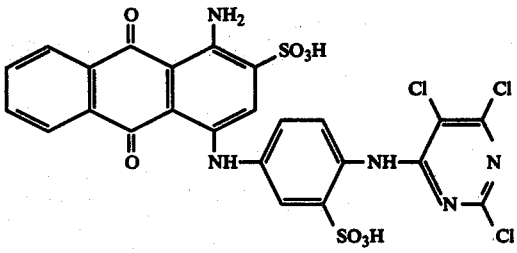 |
| 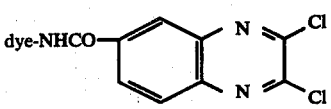 | dichloro-quinoxaline | 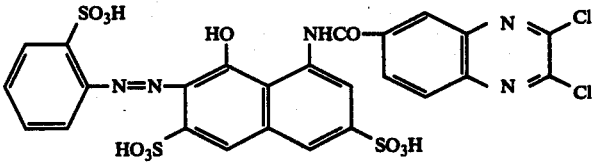 |
| dye-$SO_3NHCH_2CH_2O$ $SO_3H$ 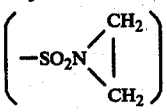 | ethylene sulfonimide | 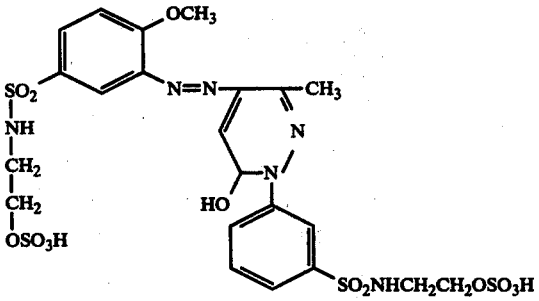 |
| dye-$CH_2NCH_2CH_2OSO_3H$ alkyl | cyclic ethylene-immonium type | 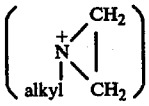 |
| dye-$SO_2CH_2CH_2OSO_3H$ ($-SO_2CH{=}CH_2$) | vinyl sulfone | 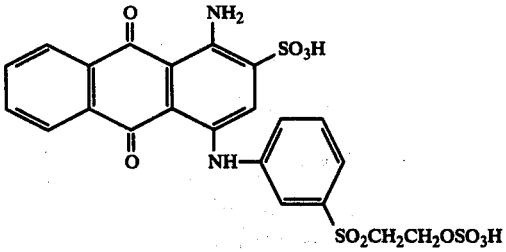 |

-continued

| Reactive group | Name | Example |
|---|---|---|
| dye-NHCCH$_2$CH$_2$OSO$_3$H ‖ O (—NHCCH=CH$_2$) ‖ O | acrylamide | 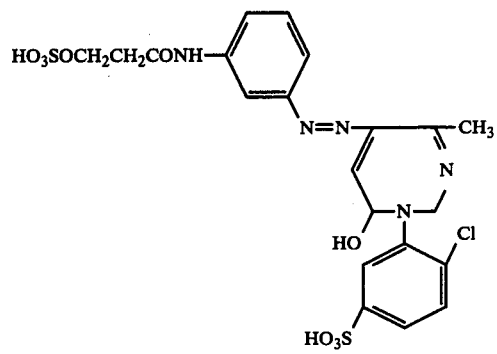 |

When employing additional constituents in the liquid dye admixture containing a fiber reactive dyestuff, such as dye fixation agents, buffers, penetrants, defoaming agents and the like, the particular choice of such other constituents can vary widely, the only requirement being that such constituents be compatible with the liquid dye admixture, and the substrate being dyed. The following list of such constituents is set forth to illustrate same:

dye fixation agents — urea, thiourea, cyanoguianidine, heavy metal salts, such as zinc sulfate, formaldehyde, formaldehyde donors, such as urea formaldehyde resins, formaldehyde containing dicyandiamines, and other fixation agents well known in the art.

buffers — sodium bicarbonate, sodium carbonate, potassium bicarbonate, potassium carbonate, and other buffers well known in the art.

penetrants — sulfonates of alkyl esters, such a dioctyl sodium sulfosuccinate, alkyl aryl polyethocy alcohols, such as octylphenol polyethoxyethanol having an average of about 12 to 13 moles of the ethoxy constituent per molecule, and other penetrants well known in the art.

defoaming agent (e.g., anti-foaming agents) can be any suitable defoaming agent known in the art, such as the well known silicone defoaming agents, 2-ethyl hexanol, and the like.

In order to further illustrate the process of the subject invention, the following Example is given. In the Example all parts and percentages are by weight unless otherwise indicated.

EXAMPLE

A series of runs were conducted utilizing the process of the invention as hereinbefore described. The application of the aqueous dye admixture was accomplished using a printing roller having spiral engravings of about 30 cuts/inch. The aqueous dye admixture containing the following:

| | |
|---|---|
| (a) dyestuff (quinoxaline)[1] | 1% |
| (b) dyestuff fixation agent (urea) | 6.64% |
| (c) buffer (sodium bicarbonate) | 1.78% |
| (d) penetrant (FB-50 Penetrant[2]) | .49% |
| (e) defoaming agent (2-ethyl hexanol) | .98% |
| (f) water | 89.11% |

[1]Fiber reactive dyestuff
[2]FB-50 Penetrant - a commercial available anionic surfactant In one series of runs, one surface of the moisture absorbent cellulose containing textile material, the surface opposite the surface of the material which was printed with the aqueous dye admixture was maintained in a moist state by maintaining the gray backing in a wetted condition. The cellulose containing textile material was characterized as having about two-thirds filling yarns and about one-third warp yarns, such yarns being formed of the same fiber mix, a cotton-acrylic fiber mix containing 60% cotton and 40% acrylic. The dyed textile material was dried at a temperature of 350° F for about 2 minutes. Such drying, however, did not occur until the migration of the dye admixture to the unprinted surface of the fabric had occurred. Further, it was noted that the use of the anionic surfactant (penetrant) promoted the dye admixture to the unprinted surface of the textile material and assisted in the fixation of the fiber reactive dyestuff to the acrylic fibers of the textile material.

The product so produced had a substantially uniform color throughout the textile material, had excellent washfastness.

Another run was conducted using substantially the same conditions and procedures set forth above with the exception that the surface opposite the surface of the textile material printed with the aqueous dye admixture was not moistened with a wetted gray backing fabric. The product so produced was not uniform in color, did not have even penetration of the dyestuff through the textile material, and was inferior to the product produced above.

Thus, the above example clearly illustrates the improved process for dyeing highly moisture absorbent cellulose containing textile materials of the present invention.

Having thus described the invention, we claim:

1. An improved method for dyeing highly moisture absorbent cellulose containing textile materials having a ratio of filling to warp of between 77 to 23 and 50 to 50 in which such textile materials are woven from yarn having a range of twist multiplier of from about 2.25 to about 5.00 comprising (a) applying an effective amount of water to a first surface of said cellulose containing textile material to moisten said first surface;

(b) applying an effective amount of a liquid dye admixture to a second surface of said cellulose containing textile material to sufficiently cover said second surface, said second surface being opposite said first surface;

(c) maintaining the resulting textile material in a holding zone for a period of time effective to allow the dyestuff constituent of said liquid dye admixture to migrate throughout said cellulose containing textile material; and (d) heating the dyed textile material at a temperature of from about 300° F to about 400° F for a period of time effective to fix the dyestuff to said textile material.

2. The method of claim 1 wherein said heating is carried out for a period of time of from about 1 to about 5 minutes.

3. The method of claim 2 wherein said liquid dye admixture is an aqueous dye admixture containing from about 0.25 to about 5 weight percent of a dyestuff constituent selected from the group consisting of soluble vat dyes and fiber reactive dyes.

4. The method of claim 2 wherein said liquid dye admixture is an aqueous dye admixture containing from about 0.25 to about 5 weight percent of a fiber reactive dyestuff constituent, and said aqueous dye admixture further contains from 0 to about 20 weight percent of a dye fixation agent, from about 1 to about 6 weight percent of a buffer, from about 0.1 to about 2.5 weight percent of a penetrant and from about 0.1 to about 2.5 weight percent of a defoaming agent.

5. The method of claim 4 wherein said aqueous dye admixture is applied to said second surface of said textile material by printing.

6. The method of claim 5 which further includes passing the dyed textile material over a plurality of heating surfaces prior to partially drying said dyed textile material prior to heating of same to fix the dyestuff to said textile material.

7. The method of claim 6 which further includes the steps of passing said substantially dried dyed textile material over a tenter frame to stretch said textile material, cutting the stretched textile material into predetermined widths, cutting the material for a second time to provide towels of predetermined sizes, and over-edging the edges of the towels to prevent fraying of said edges.

8. The method of claim 7 wherein said dyestuff constituent of said aqueous dye admixture is a fiber reactive dye and said aqueous admixture contains from about 0.5 to about 2.0 weight percent of said fiber reactive dye, from about 3 to about 7 weight percent of said dye fixation agent, from about 1.5 to about 3 weight percent of said buffer, from about 0.2 to about 0.5 weight percent of said penetrant, and from about 0.2 to about 1 weight percent of said defoaming agent.

9. The method of claim 8 wherein said fixation agent is urea, said buffer is sodium bicarbonate, and said defoaming agent is 2-ethyl hexanol.

10. An improved continuous method for dyeing highly moisture absorbent cellulose containing textile materials having a ratio of filling to warp of between 77 to 23 and 50 to 50 in which such textile materials are woven from yarn having a range of twist multiplier of from about 2.25 to about 5.00 comprising (a) passing the cellulose containing textile material into a first accumulator zone;

(b) withdrawing said material from said first accumulator zone at a rate constant with the introduction of said material into said first accumulator zone;

(c) passing the material withdrawn from said first accumulator zone through selvage rollers to further insure the flatness of the textile material;

(d) contacting a first surface of said textile material with a water-wetted gray backing fabric;

(e) printing an aqueous dye admixture containing from about 0.25 to about 5 weight percent of a fiber reactive dyestuff onto a second surface of said textile material, said second surface being opposite said first surface;

(f) passing the dyed textile material into a second accumulator zone and maintaining said dyed textile material therein for a period of time effective to allow said dyestuff to migrate throughout said textile material;

(g) withdrawing said material from said second accumulator zone at a rate constant with the introduction of said material into said second accumulator zone;

(h) passing the textile material over a plurality of heated surfaces to remove a portion of the water from the dyed textile material;

(i) heating the partially dried textile material at a temperature of from about 300° F to about 400° F for a period of time of from about 1 to about 5 minutes to fix said dyestuff to said textile material and substantially dry same;

(j) passing said substantially dry dyed textile material over a tenter frame to stretch said textile material;

(k) cutting the stretched textile material into predetermined widths; and (l) recovering each segment of the cut dyed textile material on a take-up roll.

11. The process of claim 10 wherein said cellulose containing textile materials are further characterized in that the warp and filling yarns of said textile materials are a blend containing from about 68 to 50 percent cellulose fibers and from about 32 to about 50 percent acrylic fibers, said fiber reactive dyestuff is a dichloroquinoxaline dyestuff, said partially dried textile material is heated to a temperature of from about 325° F to about 375° F for a period of time from about 1 to about 2 minutes fix said dyestuff to said textile material and wherein said process further includes the steps of intermitting spraying said back gray cloth with water to maintain same in a water-wet condition, removing the dried dyed textile material from the take-up roll, cutting the dyed textile material into towels of predetermined sizes, and over-edging the edges of the towels to prevent fraying of said edges.

* * * * *

UNITED STATES PATENT OFFICE

CERTIFICATE OF CORRECTION

Patent No. 4,134,724 Dated January 16, 1979

Inventor(s) Dewey T. Thompson, John H. Parkins, James B. Nichols

It is certified that error appears in the above-identified patent and that said Letters Patent are hereby corrected as shown below:

Column 1, line 50, change "will" to --well--.

Column 6, line 31, change "th" to --the--.

Column 7, on the last structural formula appearing at bottom of page, change "etc" to --Cl--.

Column 8, delete the first structural formula which appears and insert therefor:

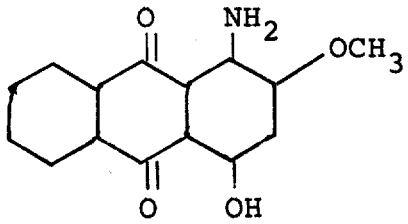

UNITED STATES PATENT OFFICE

CERTIFICATE OF CORRECTION

Patent No. 4,134,724 Dated January 16, 1979

Inventor(s) Dewey T. Thompson, John H. Parkins, James B. Nichols

It is certified that error appears in the above-identified patent and that said Letters Patent are hereby corrected as shown below:

Column 8, delete the third structural formula shown and insert therefor:

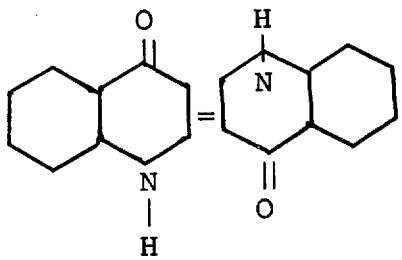

Column 11, line 35, delete "a".

Signed and Sealed this

*Fifteenth* Day of *January 1980*

[SEAL]

*Attest:*

*Attesting Officer*

SIDNEY A. DIAMOND

*Commissioner of Patents and Trademarks*